US006130862A

United States Patent [19]

Upton

[11] Patent Number: 6,130,862

[45] Date of Patent: Oct. 10, 2000

[54] WRISTWATCH ASSEMBLY WITH SWINGABLE WATCHCASE SUPPORT

[75] Inventor: Claudia Upton, Forest Hills, N.Y.

[73] Assignee: E. Gluck Corporation, Long Island City, N.Y.

[21] Appl. No.: 09/135,341

[22] Filed: Aug. 17, 1998

[51] Int. Cl.[7] ..... G04B 37/00

[52] U.S. Cl. ..... 368/282

[58] Field of Search ..... 368/281, 282, 368/67, 280, 223, 277, 278, 227

[56] References Cited

U.S. PATENT DOCUMENTS

D. 318,808 8/1991 Yum .
1,085,857 2/1914 Fitch .
1,139,110 5/1915 Depollier .
1,153,075 9/1915 Hathaway .
1,204,902 11/1916 Poltock .
2,229,978 1/1941 Kolberg .
5,257,246 10/1993 Ehsman ..... 368/282
5,577,007 11/1996 Houlihan .

*Primary Examiner*—Bernard Roskoski
*Attorney, Agent, or Firm*—Gottlieb, Rackman & Reisman, P.C.

[57] ABSTRACT

An improved wristwatch assembly is provided. The wristwatch assembly comprises a watchcase and a bangle bracelet. One end of the bracelet is fixed to the case, while the other end "swingably" wraps around the case, creating an integrated design flow. The swingable motion of the case not only is aesthetically pleasing, but enables the watch design to be easily placed on the wrist and conform thereto, as well as to be easily removed from the wrist.

7 Claims, 3 Drawing Sheets

WRISTWATCH ASSEMBLY WITH SWINGABLE WATCHCASE SUPPORT

BACKGROUND OF THE INVENTION

This invention relates to an improved mechanism for having a watchcase integrated with a bangle bracelet, and more particularly, to a wristwatch assembly having a swingable watchcase support for permitting the wristwatch assembly to better conform to the contours of the wearer's wrist.

Conventional bangle bracelet designs for wristwatches are less than desirable. Because the bangle elements comprise fixed arcuate metal elements, a bangle bracelet is difficult to place onto and off the wearer's wrist. Oftentimes, a bangle design which is somewhat larger in size than the wearer's wrist is used, in part because it can more easily close over the wrist without difficult manipulation. However, such a design will fit loosely on the wearer's wrist, which is both annoying and unattractive.

Accordingly, it would be desirable to provide an improved wristwatch assembly which overcomes the above disadvantages. In particular, it would be desirable to provide a wristwatch design incorporating a bangle bracelet which better conforms to the contours of the wrist without sacrificing ease of placement and removal.

SUMMARY OF THE INVENTION

Generally speaking, in accordance with the invention, an improved wristwatch assembly is provided. The wristwatch assembly comprises a watchcase and a bangle bracelet. One end of the bracelet is fixed to the case, while the other end "swingably" wraps around the case, creating an integrated design flow. The swingable motion of the case not only is aesthetically pleasing, but enables the watch design to be easily placed on the wrist and conform thereto, as well as to be easily removed from the wrist.

In particular, the wristwatch assembly comprises a case with a 6 o'clock end and a 12 o'clock end, and a bracelet having a first end connected to the 6 o'clock end of the case and a second end connected to the 12 o'clock end of the case. The assembly further includes a pivoting lug or bangle member swingably connecting one of the bracelet ends at either the 6 o'clock or 12 o'clock ends of the case. The lug comprises a pair of arms encircling a portion of the case. The arms are pivotally attached to the case, enabling the lug or bangle member to be freely swingable about the case. The other end of the bracelet includes a lug or bangle member that is fixed to the opposite end of the case.

Significantly, in the various assemblies of the inventive watch assembly, there is provided a recessed element in the swingable lug or bangle member for accommodating the watch crown.

In one embodiment, the crown is placed at the 6 o'clock position, and a recess is formed in the lug member surrounding the watchcase in order to accommodate the crown. This design is used to camouflage the crown and improve the flow of the watch style. In other versions of the inventive watch assembly, the crown remains at the conventional 3 o'clock position.

Accordingly, it is an object of the invention to provide an improved wristwatch assembly which conforms to the contours of a wearer's wrist.

Another object of the invention is to provide an improved wristwatch assembly having a swingable watchcase support.

Yet a further object of the invention is to provide an improved wristwatch assembly which has a nice flow, does not reveal the inner workings of the watch unit, and is otherwise aesthetically pleasing.

Still other objects and advantages of the invention will in part be obvious, and will in part be apparent from the following description.

The inventive wristwatch assembly comprises the features of construction and arrangement of parts as detailed in the following description, and the scope of the invention is indicated in the claims at the end hereof.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENTS

Figure 1:
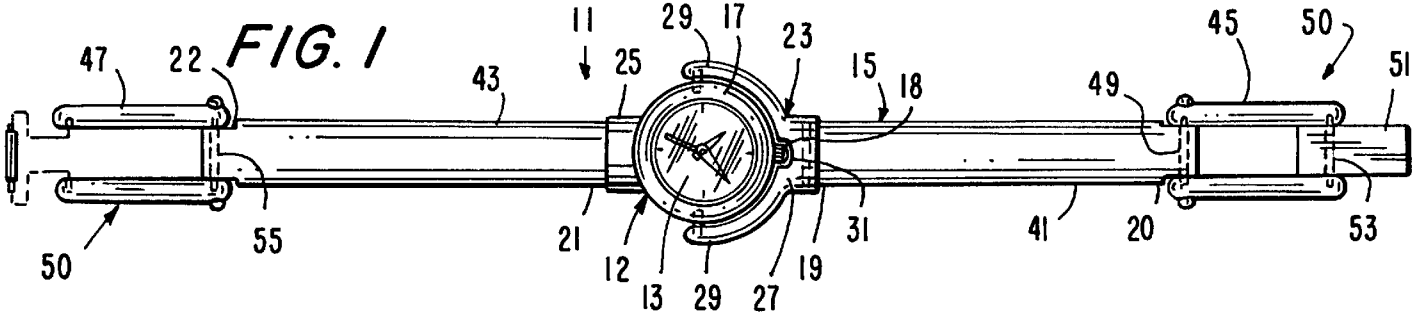
FIG. 1 is top plan view of the inventive wristwatch assembly in an open condition.

Referring first to FIGS. 1–4, a first embodiment of the inventive wristwatch assembly is shown and generally indicated at 11. Wristwatch assembly 11 comprises a case generally indicated at 12 and a bracelet generally indicated at 15. Bracelet 15 includes a first curved rigid bangle member 41, and a second curved rigid bangle member 43. Bangle member 41 has a first end 19 swingably connected to case 12, as described later on, and a second end 20. Bangle member 43 has a first end 21 fixedly connected to case 12 and a second end 22. End 20 of bangle member 41 and end 22 of bangle member 43 are selectively coupled by means of a clasp assembly, generally indicated at 50.

Clasp assembly 50 includes a first link member 45 pivotally connected to end 20 of bangle member 41 by means of a pivot pin 49, and a second link member 47 pivotally connected to end 22 of bangle member 43 by means of a pivot pin 55. Clasp assembly 50 further includes a clasp element 51 swingably connected to link member 45, and which may be coupled to link member 47, as is well known in the art, in order to selectively connect end 20 of bangle member 41 to end 22 of bangle member 43, as best shown in FIG. 2.

Continuing now with FIGS. 1–4, case 12 is now described. Case 12 is of a conventional circular or round design and includes a watch dial 13 and a bezel 17. Case 12 further includes an extending crown 18 placed at the 6 o'clock position therealong, and which is used for setting and adjusting the time depicted on watch dial 13, as is well known.

Figure 3:
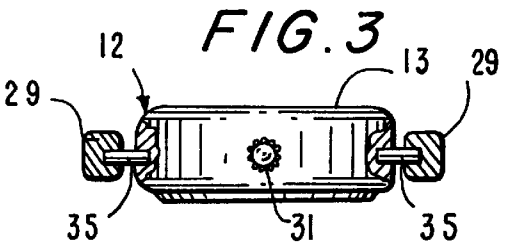
FIG. 3 is a partial cross-sectional view taken along line 3—3 of FIG. 2.

In order to link end 19 of bangle member 41 to the 6 o'clock end of case 12, a pivoting lug member generally indicated at 23 is provided. Lug member 23 comprises a body 27 and a pair of encircling arms 29 for swingably connecting lug member 23 to case 12. Body 27 of lug member 23 is connected to end 19 of bangle member 41 by means of a pin 33 (see FIG. 4). Arms 29 of lug member 23 are swingably coupled to the sidewall of case 12 (along bezel 17) by means of a pair pivoting pins 35, as best shown in FIGS. 2 and 3. This enables watch assembly 11, as shown in FIG. 2, to swing between a closed condition (solid line) and a swung-out condition (dotted line).

Figure 2:
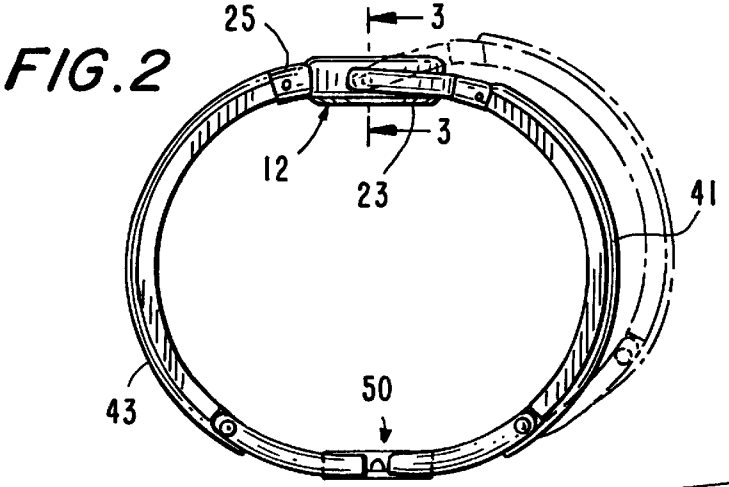
FIG. 2 is a side elevational view of the wristwatch assembly of FIG. 1 in a closed condition (solid line) and a swung-out condition (dotted line)
Figure 4:
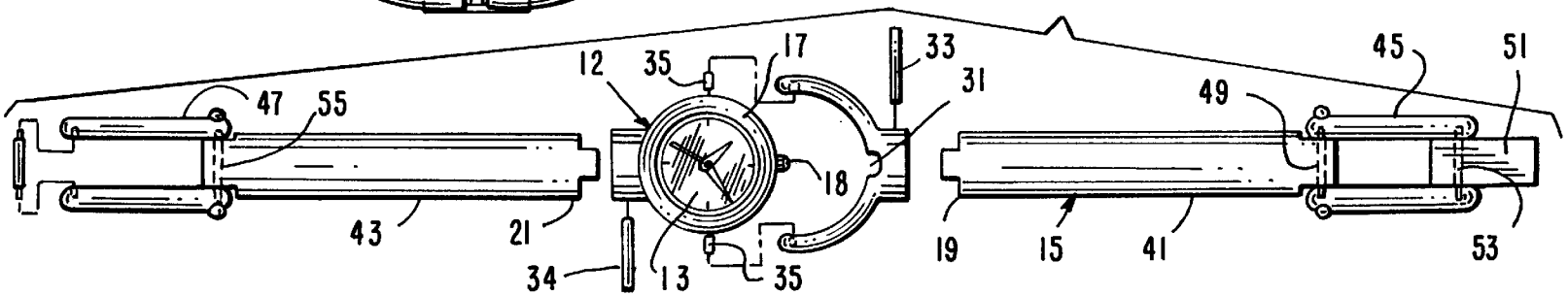
FIG. 4 is a top exploded view showing the various component parts of the inventive wristwatch assembly.

Referring to FIGS. 1 and 2, end 21 of bangle member 43 is fixedly and irrotatably attached to the opposite or 12 o'clock end of case 12 by means of lug member 25. Lug member 25 is integrally formed with bezel 17 of case 12 and is coupled to end 21 of bangle member 43 by means of a pin 13 (see FIG. 4).

Significantly, body 27 of lug member 23 is formed with a central recess or cutout 31 in order to selectively accommodate crown 18 located at the 6 o'clock position along case 12, thereby still enabling lug member 23 to swingably pivot with respect to case 12, as shown in FIG. 2.

When wristwatch assembly 11 is worn about the wearer's wrist, lug member 23 is able to pivotally swing with respect to case 12 in order to provide a secure, yet comfortable, fit about the wrist of the wearer. Moreover, this swingable motion of lug member 23 with respect to case 12 of assembly 11 enables the assembly to be more easily put on the wrist, and more easily removed therefrom.

Turning now to FIGS. 5–8, a second embodiment of a wristwatch assembly made in accordance with the invention is now described and generally indicated at 111. Assembly 111 comprises a case generally indicated at 112 and a bracelet generally indicated at 115. Case 112 is substantially rectangular in configuration, and, as before, includes a watch dial 113 and a bezel 117 framing watch dial 113. Case 112 further includes a protruding time-adjusting crown 118 located at the 3 o'clock position. Crown 118 is used for selectively adjusting the time depicted on watch dial 113, as is well known.

Figure 5:
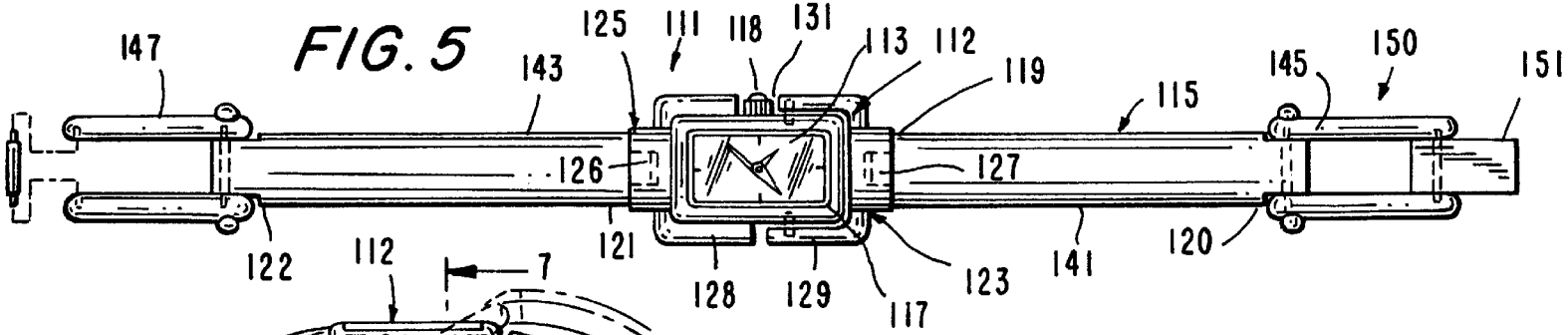
FIG. 5 is a top plan view of a second embodiment of the inventive wristwatch assembly in an open condition.
Figure 6:
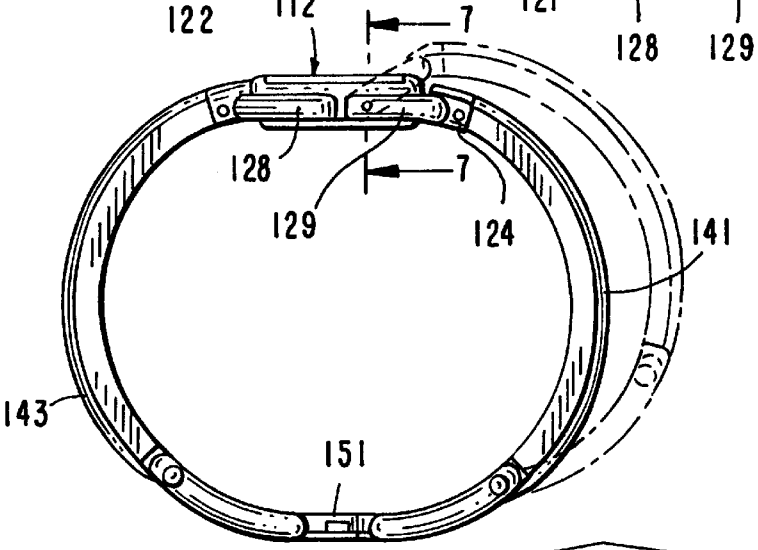
FIG. 6 is a side elevational view of the wristwatch assembly depicted in FIG. 5 in a closed condition (solid line) and a swung-out condition (dotted line)

Bracelet 115 comprises a first curved rigid bangle member 141 and a second curved rigid bangle member 143, as shown in FIGS. 5 and 6. Bangle member 141 has a first end 119 which is swingably coupled to watchcase 112, as described below, and a second end 120. Bangle member 143 has a first end 121 fixedly and irrotatably coupled to case 112 and a second end 122. As before, end 120 of bangle member 141 is selectively coupled to end 122 of bangle 143 by means of a clasp assembly generally indicated at 150. Clasp assembly 150 includes a first link member 145 pivotally connected to end 120 of bangle member 141, a second link member 147 pivotally connected to end 122 of bangle member 143, and a clasp 151 for selectively connecting link member 145 to link member 147, as is well known.

Figure 7:
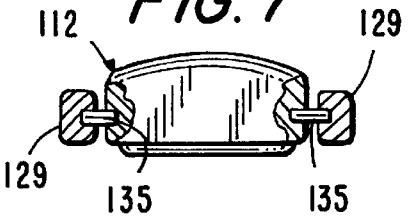
FIG. 7 is a partial cross-sectional view taken along line 7—7 of FIG. 6.
Figure 8:
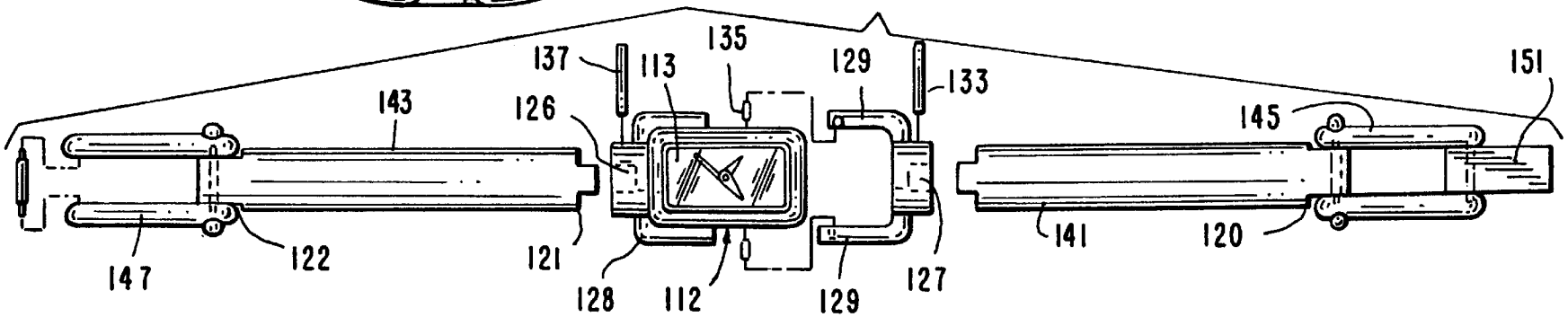
FIG. 8 is a top plan exploded view showing the various component parts of the second embodiment of the inventive wristwatch assembly.

Referring now to FIGS. 5 and 7, end 121 of bangle member 143 is fixedly and irrotatably attached to the 12 o'clock end of case member 112 by means of a lug member 125. Lug member 125 is integrally formed with bezel 117, and includes a body 126 and a pair of arms 128 fixedly and irrotatably attached to and encircling the 12 o'clock end of case 112. Body 126 of lug member 125 is fixedly connected to end 121 of bangle member 143 by means of a pin 137, as shown in FIG. 8.

Still referring to FIGS. 5 and 7, end 119 of bangle member 141 is swingably coupled to the 6 o'clock end of case 112 by means of a lug member 123. Lug member 123 comprises a body 127 connected to end 119 of bangle member 115 by means of a pin 133, and a pair of arms 129 encircling the 6 o'clock end of case 112. Arms 129, as shown in FIG. 7, are pivotally coupled to the sidewall of case 112 (along bezel 117) by means of a pair of pivot pins 135. This enables watch assembly 11, as shown in FIG. 6, to swing between a closed condition (solid line) and a swung-out condition (dotted line).

Referring now to FIG. 5, in order to accommodate crown 118 of case 112, one set of facing arms 128 and 129 of lug members 125 and 123 respectively (on the 3 o'clock side of case 112) are slightly shorter in length than arms 128 and 129 on the other side, thereby defining a gap 131 in which crown 118 is selectively disposed.

Turning now to FIGS. 9–12, a third embodiment of a wristwatch assembly made in accordance with the invention is described and generally indicated at 211. Assembly 211 comprises a watchcase 212 and a bracelet 215. Watchcase 212 has a substantially oval configuration and comprises a dial 213, an oval bezel 217 framing dial 213 and a depending crown located at the 3 o'clock position.

Bracelet 215 comprises a first bangle member 241 swingably connected to case 212 at its 6 o'clock end, as described below, and a second bangle member 243 fixed to case 212 as its 12 o'clock end. Bangle 241 has a first end 220 pivotally coupled to a bracelet element 250 by means of a pivot pin 252, and a second end 219 swingably coupled to case 212. Bangle member 243 has an end 222 pivotally connected to a bracelet element 247 by means of a pivot pin 248 and a second end 221 fixedly and irrotatably coupled to case 212. Bracelet elements 247 and 250 are interconnected to each other by a series of link members 251, as is well known in the art.

Figure 9:
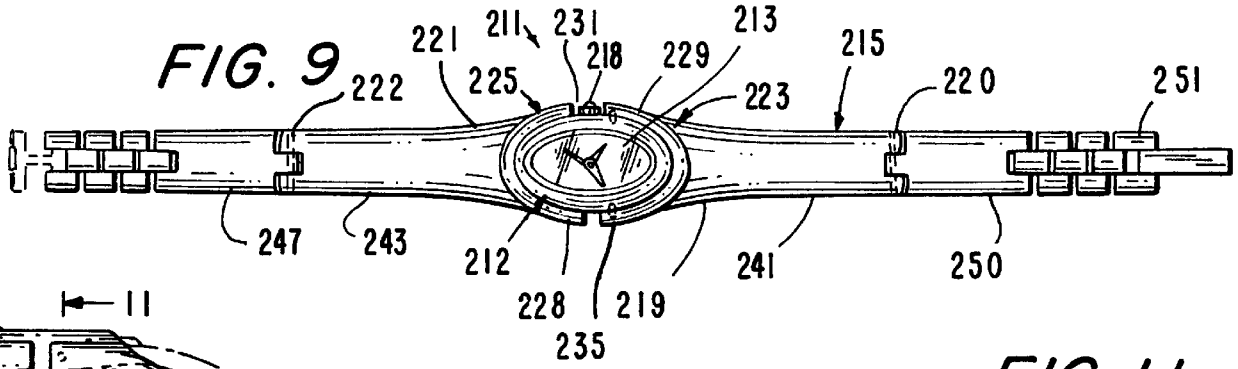
FIG. 9 is a top plan view of a third embodiment of the inventive wristwatch assembly shown in an open condition.
Figure 12:
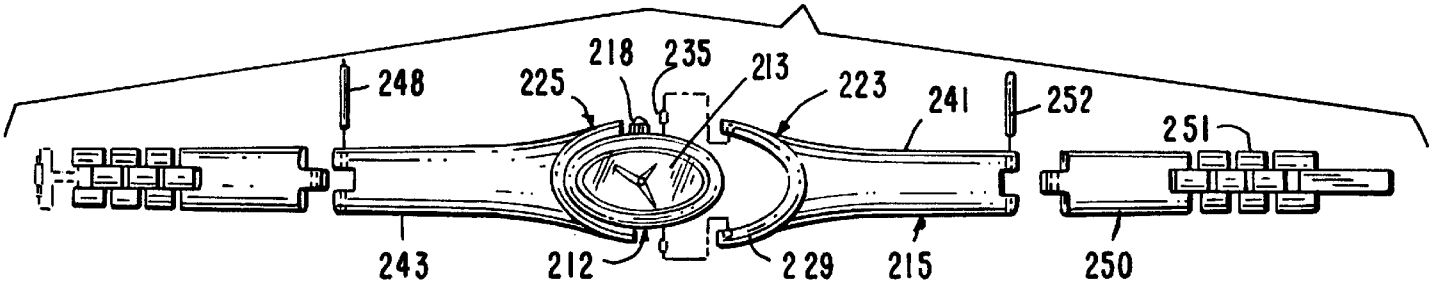
FIG. 12 is a top plan exploded view showing the various component parts of the third embodiment of the inventive wristwatch assembly.

Bangle member 243, as best shown in FIGS. 9 and 12, is integrally formed with a lug member 225 at end 221. Lug member 225 is substantially arcuate in design and is formed with a pair of arms 228 which encircle and are otherwise irrotatably fixed to case 212 at the 12 o'clock end.

Figure 11:
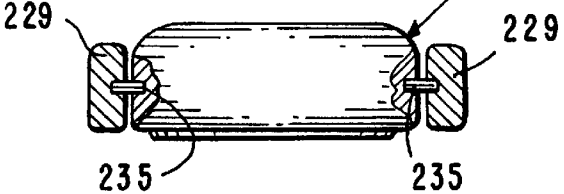
FIG. 11 is a partial cross-sectional view taken along line 11—11 of FIG. 10.
Figure 10:
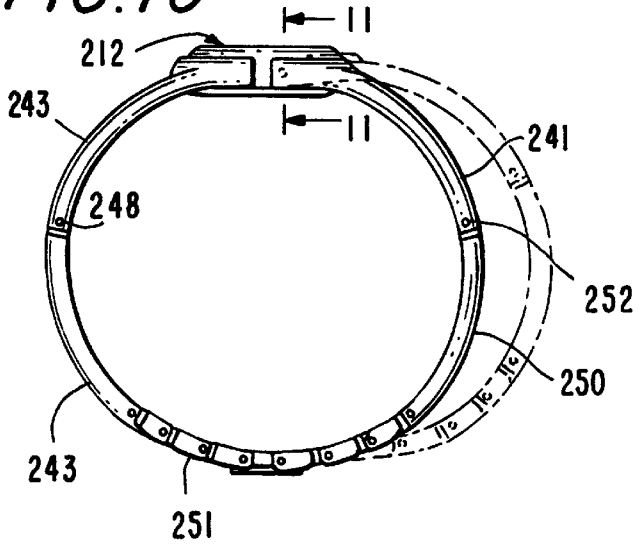
FIG. 10 is a side elevational view of the wristwatch assembly depicted in FIG. 9 in both a closed condition (solid line) and a swung-out condition (dotted line)

Bangle member 241 is integrally formed at end 219 with a lug member 223 which is swingably connected to case 212. Lug member 223 is substantially arcuate in design and includes a pair of arms 229 which encircle case 212 at the 6 o'clock end. Arms 229 of lug member 223 are swingably connected to case 212 by means of pins 235, as shown in FIGS. 10 and 11. As with the embodiments of FIGS. 5–8, a gap or space 231 is provided between one set of facing arms 228 and 235 (along the 3 o'clock side) in order to accommodate crown 218.

The improved watch assembly of the invention, which comprises a case and band or bracelet portion, is designed to better conform to the contours of a wearer's wrist. This is because of the swingable watch case support features, which enable a much better fit of the watch assembly about the wearer's wrist.

The swingable watch case design of the inventive assembly is always provided with a recess for accommodating the watchcase crown, whether the crown is located at the conventional 3 o'clock position, or in the case of certain watches, at other locations, such as at 12 o'clock or 6 o'clock positions.

It will thus be seen that the objects set forth above, among those made apparent from the preceding description, are efficiently attained, and, since certain changes may be made in the above constructions without departing from the spirit and scope of the invention, it is intended that all matter contained in the above description and shown in the accompanying drawings, shall be interpreted as illustrative and not in a limiting sense.

It is also to be understood that the following claims are intended to cover all of the generic and specific features of the invention herein described, and all statement of the scope of the invention, which, as a matter of language, might be said to fall therebetween.

What is claimed is:

1. A wristwatch assembly comprising:

a case including a sidewall and having a 6 o'clock end and a 12 o'clock end;

a band or bracelet having a first end connected to said 6 o'clock end of said case and a second end connected to said 12 o'clock end of said case;

wherein one of said ends of said band or bracelet includes a lug member that at least partially encircles the sidewall of said case at said corresponding end thereof and is pivotally attached to said case sidewall such that said lug member is substantially freely swingable with respect to said case;

wherein the other of said ends of said band or bracelet is irrotatably and fixedly attached to the selected end of said case;

wherein said pivotally attached lug member is formed with a cutout for accommodating a time adjusting crown extending from said case sidewall along said corresponding end of said case.

2. The assembly of claim 1, wherein said lug member comprises a body and at least one arm pivotally coupled to said case sidewall.

3. The assembly of claim 1, wherein at least a portion of said band or bracelet comprises a rigid bangle member.

4. The assembly of claim 1, wherein said band or bracelet includes a clasp unit for selectively opening and closing said band or bracelet.

5. The assembly of claim 1, wherein a portion of said band or bracelet is formed with a plurality of link elements.

6. The assembly of claim 2, wherein said case includes an encircling bezel element.

7. The assembly of claim 2, wherein said case has a sidewall from which a time-adjusting crown extends.

* * * * *